US006070049A

United States Patent [19]

Hayashida

[11] Patent Number: 6,070,049

[45] Date of Patent: May 30, 2000

[54] IMAGE FORMING APPARATUS HAVING A CONVEYOR GUIDE FOR CONVEYING AN IMAGE RECEIVING MEDIUM WITHOUT DISTURBING THE FORMED IMAGE

[75] Inventor: Masatoshi Hayashida, Kanagawa-ken, Japan

[73] Assignee: Kabushiki Kaisha Toshiba, Kanagawa-ken, Japan

[21] Appl. No.: 09/164,352

[22] Filed: Oct. 1, 1998

[30] Foreign Application Priority Data

Oct. 3, 1997 [JP] Japan ..... 9-271138

[51] Int. Cl.[7] ..... G03G 15/00

[52] U.S. Cl. ..... 399/400; 399/397

[58] Field of Search ..... 399/397, 400, 399/406, 313, 312, 320

[56] References Cited

U.S. PATENT DOCUMENTS

| | | | |
|---|---|---|---|
| 4,338,017 | 7/1982 | Nishikawa | 399/313 X |
| 4,369,729 | 1/1983 | Shigenobu et al. | 399/320 X |
| 5,138,363 | 8/1992 | Yuge | 399/313 X |
| 5,166,737 | 11/1992 | Tomita | 399/400 |
| 5,225,879 | 7/1993 | Hayashida . | |
| 5,268,725 | 12/1993 | Koga et al. | 399/312 |
| 5,722,012 | 2/1998 | Saitoh | 399/400 X |
| 5,729,811 | 3/1998 | Takahata et al. | 399/397 X |
| 5,749,035 | 5/1998 | Ban et al. | 399/397 X |

FOREIGN PATENT DOCUMENTS

| | | |
|---|---|---|
| 56-87070 | 7/1981 | Japan . |
| 57-128356 | 8/1982 | Japan . |
| 62-240986 | 10/1987 | Japan . |
| 63-083767 | 7/1996 | Japan . |

*Primary Examiner*—Susan S. Y. Lee
*Attorney, Agent, or Firm*—Foley & Lardner

[57] ABSTRACT

An image forming apparatus includes a developing device to form a developer image by developing an electrostatic latent image formed on an image carrier by developing using a developer, a transfer device to transfer a developer image formed on an image carrier, a fixing device to fix a developer image transferred on an image receiving medium, and a conveyor guide 7 arranged so that the image receiving medium with a developer image transferred thereon to guide from the transfer device toward the fixing device. The conveyor guide has contact portions made of a material that is charged to the same polarity as the developer on the image receiving medium as a result of the friction with the image receiving medium.

3 Claims, 1 Drawing Sheet

IMAGE FORMING APPARATUS HAVING A CONVEYOR GUIDE FOR CONVEYING AN IMAGE RECEIVING MEDIUM WITHOUT DISTURBING THE FORMED IMAGE

BACKGROUND OF THE INVENTION

1. Field of the Invention

The present invention relates to an image forming apparatus and, more particularly, to an image forming apparatus, which transfers images on an image-receiving medium.

2. Description of the Related Art

Generally, such image forming apparatus as copying machines, laser printers and the like have a developing device, which forms a toner image corresponding to an image information on an image carrier, a transfer device, which transfers a toner image on an image receiving medium and a fixing device, which fixes the toner image on the image receiving medium.

When forming an image on the image receiving medium by this image forming apparatus, image data are first formed on the image receiving medium as an electrostatic latent image. Then, a charged toner is supplied to the image carrier and forcing this toner to adhere to the electrostatic latent image, a toner image is formed.

Further, the toner image thus formed is transferred on the image receiving medium by utilizing the electrostatic action. The image receiving medium carrying the transferred toner image is conveyed to the fixing device, applied with pressure, heat, etc. and the toner image is fixed on the image receiving medium and thus, an image is formed thereon.

On many of such an image forming apparatus as described above, a conveyor guide is provided between the transfer device and the fixing device. This conveyor guide is a member to help an image receiving medium carrying an transferred toner image being conveyed from the transfer device to the fixing device and is arranged so that the image receiving medium is conveyed while sliding on this conveyor guide.

Accordingly, this conveyor guide is demanded not to impede an image receiving medium to move when guiding it to the fixing device. In other words, the conveyor guide is demanded to have less contact resistance with an image receiving medium. Further, because an image receiving medium and a toner moving on the conveyor guide are charged, if the conveyor guide is conductive, the charge retained on the image receiving medium and the toner flows into the conveyor guide and causes the disturbance of a toner image. Therefore, the contact portions of the conveyor guide, which contact with an image receiving medium, are required to be well insulated.

As a conveyor guide satisfying such the demand, a metallic plate is used, of which surface has a plurality of streak shaped projections and lubricated/coated film of Bakelite with a thickness of about 10 $\mu$m formed.

According to this conveyor guide, an image receiving medium slides and moves on these streak-shaped projections. Therefore, the contact resistance of this conveyor guide with the image receiving medium is less and does not impede the image receiving medium to move when it is guided to the fixing device. Further, the lubricated/coated film of Bakelite, etc. is an insulator and therefore, the electric charge hardly flows to the conveyor guide from an image receiving medium and a toner.

However, when such a conveyor guide is used, there will be generated a problem that a toner image on an image receiving medium is disturbed in the streak shape along said projections. In other words, the polarity of the electrostatic charge generated when an image receiving medium moves while sliding on the insulating conveyor guide on which the lubricated/coated film of Bakelite, etc. is formed and the charged polarity of a toner image on an image receiving medium are inverse to each other. Therefore, the toner of the toner image is attracted by the electrostatic charge generated on the conveyor guide as if the toner is left with the movement of the image receiving medium and the toner image on the image receiving medium is thus disturbed.

SUMMARY OF THE INVENTION

It is an object of the present invention to provide an image forming apparatus, which is capable of forming an image of good quality on the conveyor guide, which conveys an image receiving medium without disturbing an image formed on the image receiving medium.

According to the present invention, an image forming apparatus is provided, which comprising: developing means for developing an electrostatic latent image formed on an image carrier to form a developer image by using a developer; transfer means for transferring the developer image formed on the image carrier to an image receiving medium; fixing means for fixing the developer image transferred on the image receiving medium; and a conveyor guide arranged between the transfer means and fixing means so that the image receiving medium with the developer image transferred thereon guides from the transfer means toward the fixing means, the conveyor guide being provided with contact portions made of a material that is charged to the same polarity as a developer on said image receiving medium by the friction with the image receiving medium.

DETAILED DESCRIPTION OF THE PREFERRED EMBODIMENTS

Hereinafter, an embodiment of the present invention will be described referring to the attached drawings.

Figure 1:
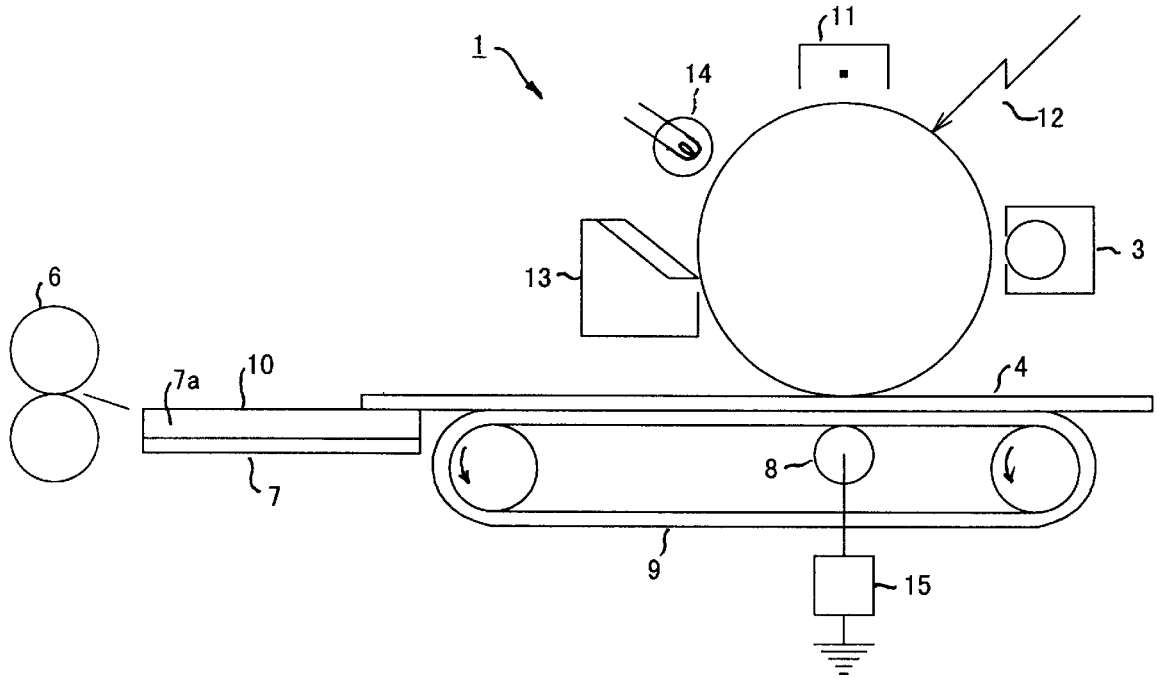
FIG. 1 is a side view schematically showing an embodiment of an image forming apparatus of the present invention.
Figure 2:
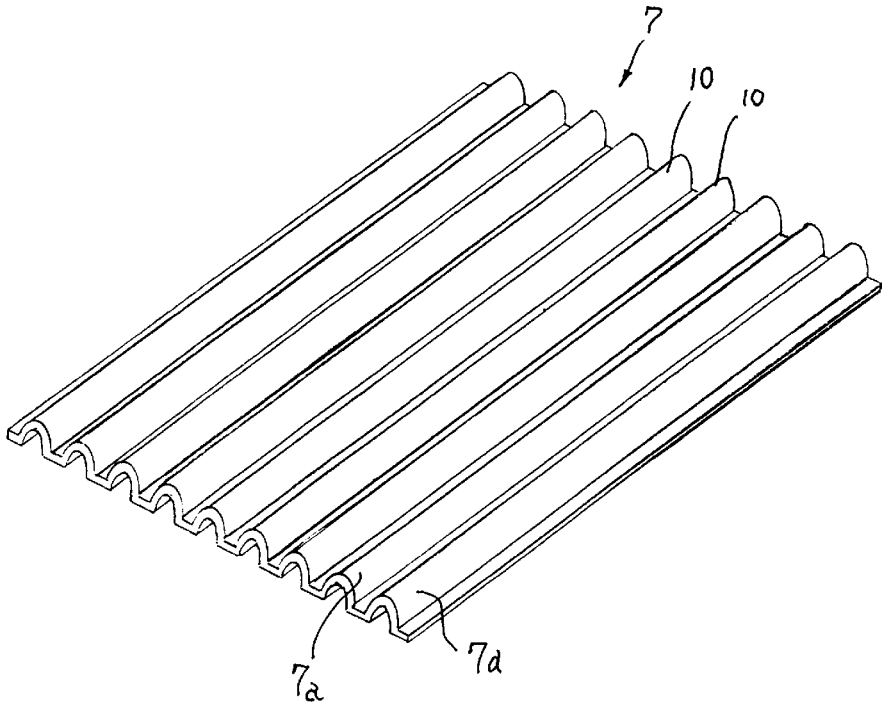
FIG. 2 is a perspective view showing a conveyor guide, which is used in an image forming apparatus shown in FIG. 1.

As shown in FIG. 1, an image forming apparatus 1 comprises a photo-conductive drum 2, which is an image carrier, a developing device 3, which forms a developer image on the surface of the photo-conductive drum 2, a transfer means 5, which transfers the developer image formed on the surface of the photo-conductive drum 2 on an image receiving medium 4 and a fixing device 6, which fixes the developer image on the image receiving medium 4. The transfer means 5 comprises a conveyor belt 9, which conveys the image receiving medium 4 carrying the transferred developer image to the fixing device 6, a transfer roller 8, which contacts the photo-conductive drum 2 via the conveyor belt 9 and acts to transfer the developer image on the photo-conductive drum 2 onto the image receiving medium 4, and a bias voltage source 15 electrically connected to the transfer roller 8 so as to apply bias voltage to the transfer roller 8. Between the conveyor belt 9 and the fixing device 6, the conveyor guide 7 is arranged so that the image receiving medium 4 guides, that is, slides and moves to the fixing device 6 from the conveyor belt 9.

In the image forming apparatus 1, around the photo-conductive drum 2 there are arranged a main charger 11, which charges the surface of the photo-conductive drum 2, an electrostatic latent image forming portion 12, which forms an electrostatic latent image on the surface of the charged photo-conductive drum 2 by applying a light thereto and the developing device 3, which forms a developer image by supplying a developer containing toner, etc. to the surface of the photo-conductive drum 2 on which an electrostatic latent image is formed. Furthermore, around the photo-conductive drum 2 there are also arranged a cleaner 13 for removing the toner left on the photo-conductive drum 2 after the transfer of a developer image and a charge eliminator 14 for removing the charge left on the surface of the photo-conductive drum 2.

In the image forming apparatus 1, when forming a developer image by the developing device 3, the surface of the photo-conductive drum 2 is first charged to the positive or negative by the main charger 11. Then, a light corresponding to the image information is applied to the surface of the charged photo-conductive drum 2 in the electrostatic latent image forming portion 12. In other words, a difference is produced in the surface potential between the light applied portion and the light not applied portion and as a result, an electrostatic latent image is formed on the surface of the photo-conductive drum 2.

When a charged developer is supplied from the developing device 3 to the surface of the photo-conductive drum 2 on which an electrostatic latent image is thus formed, a developer image is formed. Here, the developer image can be formed in either the normal developing process or the reversal developing process. In other words, a developer can be positive or negative charged. For instance, when a developer is charged to the same polarity as the surface of the photo-conductive drum 2, a developer image can be formed on the light applied portion of the surface of the photo-conductive drum 2. Further, when a developer is charged to the reverse polarity of the surface of the photo-conductive drum 2, a developer image can be formed on the non-light applied portion.

According to the transfer means 5, which is used in the image forming apparatus 1 of the present invention, a developer image formed on the surface of the photo-conductive drum 2 is transferred on the image receiving medium 4 by the electrostatic action, etc. For the transfer means 5, for instance, a transfer roller, which is provided facing to the photo-conductive drum 2 and to which a specified voltage is applied from the bias voltage source 15 may be pointed out. Further, it is possible to compose the transfer means 5 by the conveyor belt 9, which is arranged so as to be able to run while being kept in contact with the surface of the photo-conductive drum 2 on which a developer image is formed and the transfer roller 8 to which a specified voltage is applied from the bias voltage source 15 by keeping the conveyor belt 9 being pressed against the photo-conducive drum 2.

The image transfer using such the conveyor belt 9 is carried out as described below. First, arrange the image receiving medium 4 on the conveyor belt 9 and insert it between the photo-conductive drum 2 and the transfer roller 8 by rotating the photo-conductive drum 2 and the transfer roller 8. Further, by rotating the photo-conductive drum 2 and the transfer roller 8, bring a developer image formed on the surface of the photo-conductive drum 2 in contact with the surface of the image receiving medium 4 and apply voltage of the reverse polarity of the developer to the transfer roller 8. As a result, the developer image is transferred on the image receiving medium 4 from the surface of the photo-conductive drum 2 by the electrostatic tractive force between the photo-conductive drum 2 and the transfer roller 8.

Further, in the normal developing process, the photo-conductive drum 2 is also charged to the polarity reverse to a developer. In this case, it is therefore necessary to charge the transfer roller 8 so that the surface potential of the image receiving medium 4 becomes higher than the surface potential of the photo-conducive drum 2.

Further, the transfer means 5 is not always needed to be composed of the transfer roller 8 and the conveyor belt 9 and there is no special limitation provided that it is possible to transfer a developer image on the image receiving medium 4 from the surface of the photo-conductive drum 2.

A fixing device that is used in a general image forming apparatus is usable for the fixing device 6. A developer image formed on the image receiving medium 4 is fixed thereon by this fixing device when a specified pressure and heat are applied.

Between the transfer means 5 and the fixing device 6, there is provided a conveyor guide 7. This conveyor guide 7 is provided to assist to convey the image receiving medium 4 to the fixing device 6 from the transfer means 5 and is so arranged that the image receiving material 4 with a developer image transferred thereon guides, that is, slides and moves from the transfer means 5 to the fixing device 6.

In the image forming apparatus of the present invention, as the contact portions 10 are made of an insulating material, which is charged to the same polarity as a developer by the friction with the image receiving medium 4, the disturbance of an image is hardly caused on the conveyor guide 7. The reason for this will be described below taking the image forming according to the reversal developing process with a developer charged to the negative as an example.

When forming an image according to the reversal developing process by charging a developer to the negative, first the surface of the photo-conductive drum 2 is negatively charged by the main charger 11 to the high potential of about −600 V. Then, an electrostatic latent image is formed on the negatively charged surface of the photo-conductive drum 2 by the electrostatic latent image forming portion 12, which applies the laser beam corresponding to an image information. In other words, the laser beam applied portion of the surface of the photo-conductive drum 2 becomes to a lower potential than the non-beam applied portion and an electrostatic latent image is formed on the surface of the photo-conductive drum 2.

To the surface with an electrostatic latent image formed of the photo-conductive drum 2, a negatively charged developer is further supplied from the reverse developing device 3. As a result, the negatively charged developer adheres to the laser beam applied portions only of the surface of the photo-conductive drum 2 and a developer image is formed on the surface of the photo-conductive drum 2.

Further, at this time, the non-laser beam applied portions of the photo-conductive drum 2 maintain the surface potential nearly at −600 V. Further, the area of a developer image is generally only about 10% of the surface area of the photo-conductive drum 2. Accordingly, the surface potential of the photo-conductive drum 2 is considered to be nearly about −600 V.

Then, the developer image formed on the surface of the photo-conductive drum 2 is transferred on the image receiving medium 4 using the transfer means 5. At this time, the charge on the surface of the photo-conductive drum 2 flows into the image receiving medium 4 with the transfer of the developer image. Therefore, the polarity of the developer and that of the image receiving medium 4 after the transfer become negative.

The image receiving medium 4 having the transferred developer image as above is then conveyed onto the conveyor guide 7. As described above, according to a conventional image forming apparatus a lubricated/coated film of Bakelite and the like cover the surface of the conveyor guide. This lubricated/coated film is charged to the positive polarity by the frictional contact with the image receiving medium 4. As a result, if a developer is charged to the negative polarity, the electrostatic tractive force is produced between the conveyor guide and the developer and a developer image is disturbed on the image receiving medium 4 with the movement of the image receiving medium 4.

This problem may be reduced to some extent by increasing the thickness of the lubricated/coated film of Bakelite and the like to more than 1 mm. However, it is difficult to form the film in a uniform thickness for materials that are used for the lubricated/coated film of a conventional conveyor guide. Further, a cost will increase as a result of the increase in a coating/drying time, etc. and therefore, it is also not practical. Further, even if a more than 1 mm thick lubricated/coated film is formed using such material, it is not possible to avoid the disturbance of a develop image as long as a material that is charged to the polarity reverse to a developer by the frictional contact with the image receiving medium 4 is used.

On the contrary, the contact portions of the conveyor guide 7 used in the image forming apparatus are composed using a material that is charged to the same polarity as a developer by the friction with an image receiving medium 4. In other words, in the image forming using the reverse developing process with the developer charged to the negative polarity, the contact portions of the conveyor guide 7 with the image receiving medium 4 are charged to the negative polarity as a result of the friction with the image receiving medium 4.

So, the electrostatic force of traction is not produced between the conveyor guide 7 and a developer. Therefore, it is possible to prevent the disturbance of a developer image without forming the lubricated/coated film in a thickness above 1 mm.

Although a material to be used for comprising the contact portions 10 of the conveyor guide 7, which contact the image receiving medium 4, described above differs depending on quality of material, thickness, etc. of the image receiving medium 4 to be used, when a developer is charged to the negative polarity, TEFLON (Trademark of DuPont; polytetrafluoroethylene), polyethylene, polyacetal, polyester, etc. can be pointed out. Further, when a developer is charged to the positive polarity, 66 NYLON (Trademark of DuPont; polyhexamethylene adipamide), polyester, polyacetal, etc. are pointed out.

In particular, to charge the contact portions to the negative polarity, it is desirable to use Teflon and polyethylene for the contact portions 10, while to charge it to the positive polarity, it is desirable to use 66 Nylon and polyester. When these materials are used, it is possible to effectively prevent generation of disturbance of an image on the conveyor guide 7.

If the contact portions 10 which contact the image receiving medium 4 is charged to the same polarity of a developer as a result of the friction with the image receiving medium 4, the conveyor guide 7 used in the image forming apparatus 1 of the present invention can be in various shapes without any special restriction. However, it is preferred to make this conveyor guide 7 in a shape having a less contact area with the image receiving medium 4 so as not to impede the movement of the image receiving medium wen it is guided to a fixing device.

As the conveyor guide 7 that is in such a shape, it is desirable to adopt a plate material such as a metal plate with a plurality of streaky projections 7*a* formed thereon. The conveyor guide 7 provided with the projections 7*a* can be obtained by, for instance, forming a plurality of streaky projections 7*a* on a metal plate, etc. through the extrusion molding and by coating a material, which is charged to the same polarity as a developer by the friction with the image receiving medium 4, at least on the surface of these projections 7*a*.

Further, the conveyor guide 7 provided with the projections 7*a* also can be obtained by previously forming a plurality of columnar projections using a material that is charged to the same polarity as a developer by the friction with the image receiving medium 4 and by arranging these columnar projections on the metal plate, etc. so that their long axes become in parallel with the main surface of the metal plate. When these columnar projections are used, it is possible to form higher projections at a lower cost than those projections formed using a coating method.

It is desirable to form projections, which are provided on the conveyor guide 7, to the height above 1.0 mm. When the projections are made to a height above 1.0 mm, the disturbance of an image on the conveyor guide 7 can be effectively prevented.

[Example of Experiment]

An example of an experiment of the present invention will be described in the following.

Using the image forming apparatus 1 shown in FIG. 1, an image was formed on an image receiving medium according to the method shown below.

First, the surface of the photo-conductive drum 2 was charged to −600 V. An electrostatic latent image was formed on the charged surface of the photo-conductive drum 2 using the electrostatic latent image forming portion 12. Then, by supplying a negative charged developer to the surface of the photo-conductive drum 2 having the formed electrostatic latent image, a developer image was formed.

Then, while applying a positive voltage of about 1.5 kV to the transfer roller 8 from the bias voltage source 15, the image receiving medium 4 was supplied between the photo-conductive drum 2 having a formed developer image and the transfer roller 8. A developer image was thus transferred on the image receiving medium 4.

The image receiving medium 4 carrying the transferred developer image was conveyed to the fixing device 6 via the conveyor guide 7 by the conveyor belt 9. Here, the conveyor guide 7 having a plurality of columnar projections, which were 95 mm long, 1.0 mm wide and 5.0 mm high, arranged on a metal plate that was 100 mm long in the direction of advance was used. Further, these columnar projections were so arranged that their long axes became in parallel with the direction of advance of the image receiving medium 4 and in the shape of ribs at intervals of 30 mm, and used as the contact portions 10.

The image receiving medium 4 conveyed to the fixing device 6 was heated to 150–200° C. under the specified pressure applied and the developer image was fixed on the image receiving medium 4.

Several images were formed on the image receiving medium 4 as described above with the thickness of the image receiving medium 4 and the material of the contact portions of the conveyor guide 7 were changed and the quality of each image was evaluated. The results are shown in Table 1.

TABLE 1

| Thickness Of Image Receiving Medium ($g/m^2$) | (+) ← Charge → (−) Material of Conveyor Guide Surface | | | | |
|---|---|---|---|---|---|
| | Nylon 66 | Polyester | Polyacetal | Polyethylene | Teflon |
| 50 | x | x | x | ○ | ○ |
| 64 | x | x | x | ○ | ○ |
| 80 | x | Δ | Δ | ○ | ○ |

Further, in Table 1, the thickness of the image receiving medium 4 is expressed in weight/unit area. Further, the materials of the surface of the conveyor belt 7, that is, the materials of the contact portions 10 are arranged in order of those that are charged to the positive (+) by the friction with the image receiving medium 4 at the left side and those that are charged to the negative (−) at the right side. Materials that did riot cause the disturbance of the image are shown by ○, those that caused a slight disturbance but within the permissive range are shown by Δ and those that caused a remarkable disturbance are shown by x.

As shown in Table 1, when 66 Nylon was used for the contact portions 10 of the conveyor guide 7, as it was charged to the positive (+) by the friction with the image receiving medium 4, a large image disturbance was caused. On the contrary, when polyester and polyacetal were used for the contact portions 10 of the conveyor guide 7, a slight image disturbance was caused when the thickness of the image receiving medium was 80 $g/m^2$ but the relatively good quality of image could be obtained.

Further, when polyethylene and Teflon were used for the contact portions 10 of the conveyor belt 7, the good quality of image could be obtained without causing the image disturbance regardless of the thickness of the image receiving medium 4.

As described above, according to the image forming apparatus of the present invention, as the contact portions of the conveyor guide with the image receiving medium are composed of a material that is charged to the same polarity as a developer by the friction with the image receiving medium, the electrostatic tractive force is not generated between a charged developer on the image receiving medium and the conveyor guide. Accordingly, it is possible to form an image of the good quality without causing the image disturbance on the conveyor guide.

What is claimed is:

1. An image forming apparatus comprising:

developing means for developing an electrostatic latent image formed on an image carrier to form a developer image by using a developer;

transfer means for transferring the developer image formed on the image carrier to an image receiving medium;

fixing means for fixing the developer image transferred on the image receiving medium; and a conveyor guide arranged between the transfer means and fixing means so that the image receiving medium with the developer image transferred thereon guides from the transfer means toward the fixing means, the conveyor guide being provided with contact portions made of a material that is charged to the same polarity as the developer on said image receiving medium by the friction with the image receiving medium, and the conveyor guide being provided with a plate material having a plurality of projections on one of a main surface and the contact portions of the conveyor guide, which contact the image receiving medium, are said plurality of projections.

2. An image forming apparatus as set forth in claim 1, wherein long axes of the plurality of the projections are arranged in parallel with a direction of advance of the image receiving medium on the conveyor guide.

3. An image forming apparatus as set forth in claim 1, wherein the transfer means includes;

a conveyor belt arranged in contact with the image carrier; and a transfer roller supporting the conveyor belt and being applied with voltage of the polarity reverse to the developer.

* * * * *